US010634401B2

(12) United States Patent
Kniffler et al.

(10) Patent No.: US 10,634,401 B2
(45) Date of Patent: Apr. 28, 2020

(54) HEAT PUMP WITH INTERLEAVED EVAPORATOR/CONDENSER ARRANGEMENT

(71) Applicant: Efficient Energy GmbH, Feldkirchen (DE)

(72) Inventors: Oliver Kniffler, Sauerlach (DE); Holger Sedlak, Lochhofen / Sauerlach (DE)

(73) Assignee: Efficient Energy GmbH, Feldkirchen (DE)

( * ) Notice: Subject to any disclaimer, the term of this patent is extended or adjusted under 35 U.S.C. 154(b) by 151 days.

(21) Appl. No.: 15/823,280

(22) Filed: Nov. 27, 2017

(65) Prior Publication Data

US 2018/0073784 A1 Mar. 15, 2018

Related U.S. Application Data

(63) Continuation of application No. PCT/EP2016/062060, filed on May 27, 2016.

(30) Foreign Application Priority Data

May 28, 2015 (DE) ..... 10 2015 209 848

(51) Int. Cl.
*F25B 30/02* (2006.01)
*F25B 39/00* (2006.01)
(Continued)

(52) U.S. Cl.
CPC ..... *F25B 30/02* (2013.01); *F25B 39/00* (2013.01); *F25B 39/02* (2013.01); *F25B 39/04* (2013.01); *F25B 25/005* (2013.01); *F25B 2339/047* (2013.01); *F25B 2500/01* (2013.01); *F25B 2500/18* (2013.01)

(58) Field of Classification Search
CPC ..... F15B 30/02; F15B 39/00; F15B 39/04; F15B 39/02; F15B 25/005; F15B 2339/047; F15B 2500/01; F15B 2500/18; F15B 41/00; F15B 41/06; F15B 41/067
See application file for complete search history.

(56) References Cited

U.S. PATENT DOCUMENTS 3,255,603 A * 6/1966 Johnson ..... F25C 1/16 62/123
5,520,008 A 5/1996 Ophir et al.
(Continued)

FOREIGN PATENT DOCUMENTS

DE 1965420 A1 7/1970
DE 3018918 A1 12/1981
(Continued)

*Primary Examiner* — Elizabeth J Martin
(74) *Attorney, Agent, or Firm* — Michael A. Glenn; Perkins Coie LLP

(57) ABSTRACT

A heat pump includes an evaporator for evaporating working liquid within an evaporator space bounded by an evaporator base, and a condenser for condensing evaporated working liquid within a condenser space bounded by a condenser base, the evaporator space being at least partially surrounded by the condenser space, the evaporator space being separated from the condenser space by the condenser base, and the condenser base being connected to the evaporator base.

23 Claims, 12 Drawing Sheets

(51) Int. Cl.

| | |
|---|---|
| ***F25B 39/02*** | (2006.01) |
| ***F25B 39/04*** | (2006.01) |
| ***F25B 25/00*** | (2006.01) |

(56) References Cited

U.S. PATENT DOCUMENTS

| | | | | |
|---|---|---|---|---|
| 7,257,965 | B2 | 8/2007 | Meister et al. | |
| 2009/0100857 | A1* | 4/2009 | Ophir ..... | F25B 30/00<br>62/347 |

FOREIGN PATENT DOCUMENTS

| | | | |
|---|---|---|---|
| DE | 4431887 | A1 | 3/1995 |
| DE | 60124191 | T2 | 9/2007 |
| EP | 1189007 | B1 | 11/2006 |
| EP | 2016349 | B1 | 5/2011 |
| WO | 0202202 | A2 | 1/2002 |
| WO | 2004020918 | A1 | 3/2004 |
| WO | 2014072239 | A1 | 3/2014 |

* cited by examiner evaporator base connections:
on the left: condenser intake,
in the centre: evaporator intake,
on the right: condenser drain,
at the bottom: evaporator drain schematic bottom view of the cap

| P[hPa] | 8 | 12 | 30 | 60 | 100 | 1000 |
|---|---|---|---|---|---|---|
| evap. temp. | 4°C | 12°C | 24°C | 36°C | 45°C | 100°C |

HEAT PUMP WITH INTERLEAVED EVAPORATOR/CONDENSER ARRANGEMENT

CROSS-REFERENCE TO RELATED APPLICATION

This application is a continuation of copending International Application No. PCT/EP2016/062060, filed May 27, 2016, which is incorporated herein by reference in its entirety, and additionally claims priority from German Application No. 102015209848.6, filed May 28, 2015, which is incorporated herein by reference in its entirety.

The present invention relates to heat pumps for heating, cooling or for any other application of a heat pump or to an evaporator base for such a heat pump.

BACKGROUND OF THE INVENTION

FIG. 8A and FIG. 8B provide a heat pump as is described in European Patent EP 2016349 B1. FIG. 8A shows a heat pump initially comprising a water evaporator 10 for evaporating water as a working liquid so as to generate vapor within a working vapor pipe 12 on the output side. The evaporator includes an evaporation space (evaporation chamber) (not shown in FIG. 8A) and is configured to generate an evaporation pressure smaller than 20 hPa within said evaporation space, so that at temperatures below 15° C. within the evaporation space, the water will evaporate. The water may be ground water, brine, i.e. water having a certain salt content, which freely circulates in the earth or within collector pipes, river water, lake water or sea water. Thus, any types of water, i.e. limy water, lime-free water, salty water or salt-free water, can be used. This is due to the fact that any types of water, i.e. all of said "water materials" have the favorable water property that water, which is also known as "R 718", has an enthalpy difference ratio of 6 that can be used for the heat pump process, which corresponds to more than double the typical enthalpy difference ratio of, e.g., R 134*a*.

Through the suction pipe 12, the water vapor is fed to a compressor/condenser system 14 comprising a fluid flow engine such as a radial compressor, for example in the form of a turbocompressor, which is designated by 16 in FIG. 8A. The fluid flow engine is configured to compress the working vapor to a vapor pressure at least larger than 25 hPa. 25 hPa corresponds to a condensation temperature of about 22° C., which may already be a sufficient heating flow temperature of an underfloor heating system. In order to generate higher flow temperatures, pressures larger than 30 hPa may be generated by means of the fluid flow engine 16, a pressure of 30 hPa having a condensation temperature of 24° C., a pressure of 60 hPa having a condensation temperature of 36° C., and a pressure of 100 hPa having a condensation temperature of 45° C. Underfloor heating systems are designed to be able to provide sufficient heating with a flow temperature of 45° C. even on very cold days.

The fluid flow engine is coupled to a condenser 18 configured to condense the compressed working vapor. By means of the condensing process, the energy contained within the working vapor is fed to the condenser 18 so as to then be fed to a heating system via the advance 20*a*. Via the backflow 20*b*, the working liquid flows back into the condenser.

It is possible to directly withdraw the heat (energy), which is absorbed by the heating circuit water, from the high-energy water vapor by means of the colder heating circuit water, so that said heating circuit water heats up. In the process, a sufficient amount of energy is withdrawn from the vapor so that said stream is condensed and also is part of the heating circuit.

Thus, introduction of material into the condenser and/or the heating system takes place which is regulated by a drain 22 such that the condenser in its condenser space has a water level which remains below a maximum level despite the continuous supply of water vapor and, thus, of condensate.

As was already explained, an open circuit can be used. Thus, the water, which represents the heat source, can be directly evaporated without using a heat exchanger. However, alternatively, the water to be evaporated might also be initially heated up by an external heat source via a heat exchanger. In this context one has to take into account, however, that this heat exchanger again represents losses and expenditure in terms of apparatus.

In order to also avoid losses for the second heat exchanger, which may have been present on the condenser side, the medium can be used directly there, too. When one thinks of a house comprising an underfloor heating system, the water coming from the evaporator can directly circulate within the underfloor heating system.

Alternatively, however, a heat exchanger supplied by the advance 20*a* and exhibiting the backflow 20*b* may also be arranged on the condenser side, said heat exchanger cooling the water present within the condenser and thus heating up a separate underfloor heating liquid, which typically will be water.

Due to the fact that water is used as the working medium and due to the fact that only that portion of the ground water that has been evaporated is fed into the fluid flow engine, the degree of purity of the water does not make any difference. Just like the condenser and the underfloor heating system, which is possibly directly coupled, the fluid flow engine is supplied with distilled water, so that the system has reduced maintenance requirements as compared to today's systems. In other words, the system is self-cleaning since the system only ever has distilled water supplied to it and since the water within the drain 22 is thus not contaminated.

In addition, it shall be noted that fluid flow engines exhibit the property that they—similar to the turbine of a plane—do not bring the compressed medium into contact with problematic substances such as oil, for example. Instead, the water vapor is merely compressed by the turbine and/or the turbocompressor, but is not brought into contact with oil or any other medium impairing purity, and is thus not soiled.

The distilled water discharged through the drain thus can readily be re-fed to the ground water—if this does not conflict with any other regulations. Alternatively, it can also be made to seep away, e.g. in the garden or in an open space, or it can be fed to a sewage plant via the sewer system if this is prescribed by regulations.

Due to the combination of water as the working medium with the enthalpy difference ratio, the usability of which is double that of R 134*a*, and due to the thus reduced requirements placed upon the closed nature of the system (rather, an open system is advantageous) and due to the utilization of the fluid flow engine, by means of which the compression factors that may be used are efficiently achieved without any impairments in terms of purity, an efficient and environmentally neutral heat pump process is provided which becomes even more efficient when the water vapor is directly condensed within the condenser since, as result, not a single heat changer may be used anymore in the entire heat pump process.

FIG. 8B shows a table for illustrating various pressures and the evaporation temperatures associated with said pressures, which results in that relatively low pressures are to be selected within the evaporator in particular for water as the working medium.

To achieve a highly efficient heat pump it is important for all components, i.e. the evaporator, the condenser and the compressor, to be configured in an advantageous manner.

DE 4431887 A1 discloses a heat pump system comprising a light-weight, large-volume high-performance centrifugal compressor. Vapor which leaves a compressor of a second stage exhibits a saturation temperature which exceeds the ambient temperature or the temperature of a cooling water that is available, whereby heat dissipation is enabled. The compressed vapor is transferred from the compressor of the second stage into the condenser unit, which consists of a granular bed provided inside a cooling-water spraying means on an upper side supplied by a water circulation pump. The compressed water vapor rises within the condenser through the granular bed, where it enters into a direct counter flow contact with the cooling water flowing downward. The vapor condenses, and the latent heat of the condensation that is absorbed by the cooling water is discharged to the atmosphere via the condensate and the cooling water, which are removed from the system together. The condenser is continually flushed, via a conduit, with non-condensable gases by means of a vacuum pump.

WO 2014072239 A1 discloses a condenser having a condensation zone for condensing vapor, that is to be condensed, within a working liquid. The condensation zone is configured as a volume zone and has a lateral boundary between the upper end of the condensation zone and the lower end. Moreover, the condenser includes a vapor introduction zone extending along the lateral end of the condensation zone and being configured to laterally supply vapor that is to be condensed into the condensation zone via the lateral boundary. Thus, actual condensation is made into volume condensation without increasing the volume of the condenser since the vapor to be condensed is introduced not only head-on from one side into a condensation volume and/or into the condensation zone, but is introduced laterally and from all sides. This not only ensures that the condensation volume made available is increased, given identical external dimensions, as compared to direct counterflow condensation, but that the efficiency of the condenser is also improved at the same time since the vapor to be condensed that is present within the condensation zone has a flow direction that is transverse to the flow direction of the condensation liquid.

For highly efficient condensation it is desirable for the condenser, or the condenser space, within which the condensation takes place to be as large as possible. On the other hand, the entire heat pump is to be configured in as compact a manner as possible so that it will use up less space and may also use less material during manufacturing and will thus be more cost-efficient.

SUMMARY

According to an embodiment, a heat pump may have: an evaporator for evaporating working liquid within an evaporator space bounded by an evaporator base; a condenser for condensing evaporated working liquid within a condenser space bounded by a condenser base, the evaporator space being at least partially surrounded by the condenser space, the evaporator space being separated from the condenser space by the condenser base, and the condenser base being connected to the evaporator base.

The heat pump in accordance with the present invention includes an evaporator for evaporating working liquid within an evaporator space bounded by an evaporator base and a condenser for condensing evaporated working liquid within a condenser space bounded by a condenser base. The evaporator space is at least partially surrounded by the condenser space. Moreover, the evaporator space is separated from the condenser space by the condenser base. Finally, the condenser base is connected to the evaporator base so as to define the evaporator space.

This arrangement, which is mutually "interleaved" in that the evaporator is almost entirely or even entirely arranged within the condenser, enables very efficient implementation of the heat pump with optimum space utilization. Since the condenser space extends right up to the evaporator base, the condenser space is configured within the entire "height" of the heat pump or at least within a major portion of the heat pump. At the same time, however, the evaporator space is as large as possible since it also extends almost over the entire height of the heat pump. Due to the mutually interleaved arrangement in contrast to an arrangement where the evaporator is arranged below the condenser, the space is exploited in an optimum manner. This enables particularly efficient operation of the heat pump, on the one hand, and a particularly space-saving and compact design, on the other hand, since both the evaporator and the condenser extend over the entire height. Thus, admittedly, the levels of "thickness" of the evaporator space and of the condenser space decrease. However, one has found that the reduction of the "thickness" of the evaporator space, which tapers within the condenser, is unproblematic since the major part of the evaporation takes place in the lower region, where the evaporator space fills up almost the entire volume available. On the other hand, the reduction of the thickness of the condenser space is uncritical particularly in the lower region, i.e., where the evaporator space fills up almost the entire region available since the major part of the condensation takes place at the top, i.e., where the evaporator space is already relatively thin and thus leaves sufficient space for the condenser space. The mutually interleaved arrangement is thus ideal in that each functional space is provided with the large volume where said functional space may use said large volume. The evaporator space has the large volume at the bottom, whereas the condenser space has the large volume at the top. Nevertheless, that corresponding small volume which for the respective functional space remains where the other functional space has the large volume contributes to an increase in efficiency as compared to a heat pump where the two functional elements are arranged one above the other, as is the case, e.g., in WO 2014072239 A1.

In embodiments, the compressor is arranged on the upper side of the condenser space such that the compressed vapor is redirected by the compressor, on the one hand, and is simultaneously fed into a marginal gap of the condenser space. Thus, condensation with a particularly high level of efficiency is achieved since a cross-flow direction of the vapor in relation to a condensation liquid flowing downward is achieved. This condensation comprising cross-flow is effective particularly in the upper region, where the evaporator space is large, and does not involve a particularly large region in the lower region where the condenser space is small to the benefit of the evaporator space, in order to nevertheless allow condensation of vapor particles that have reached said region.

An evaporator base connected to the condenser base is configured such that it accommodates within it the condenser intake and drain, on the one hand, and the evaporator intake and drain, it being possible, additionally, for certain passages for sensors to be present within the evaporator and/or within the condenser. In this manner, one achieves that no passages of conduits through the evaporator may be used for the capacitor intake and drain, which is almost under a vacuum. As a result, the entire heat pump becomes less prone to defects since each passage through the evaporator would present a possibility of a leak. To this end, the condenser base is provided with a respective recess in those positions where the condenser intakes and drains are located, to the effect that no condenser feed inlets/discharge outlets extend within the evaporator space defined by the condenser base.

The condenser space is bounded by a condenser wall, which can also be mounted on the evaporator base. Thus, the evaporator base has an interface both for the condenser wall and for the condenser base and additionally has all of the liquid feed inlets both for the evaporator and for the condenser.

In specific implementations, the evaporator base is configured to comprise connection pipes for the individual feed inlets, which have cross-sections differing from a cross-section of the opening on the other side of the evaporator base. The shape of the individual connection pipes is then configured such that the shape, or cross-sectional shape, changes across the length of the connection pipe, but the pipe diameter, which plays a part in the flow rate, is almost identical with a tolerance of ±10%. In this manner, water flowing through the connection pipe is prevented from starting to cavitate. Thus, on account of the good flow conditions obtained by the shaping of the connection pipes, it is ensured that the corresponding pipes/conduits can be made to be as short as possible, which in turn contributes to a compact design of the entire heat pump.

In a specific implementation of the evaporator base, the condenser intake is split up into a two-part or multi-part stream, almost in the shape of "eyeglasses". Thus, it is possible to feed in the condenser liquid in the condenser at its upper portion at two or more locations at the same time. Thus, a strong and, at the same time, particularly even condenser flow from top to bottom is achieved which enables achieving highly efficient condensation of the vapor which is introduced into the condenser from the top as well.

A further feed inlet, having smaller dimensions, within the evaporator base for condenser water may also be provided in order to connect a hose therewith which feeds cooling liquid to the compressor motor of the heat pump; what is used to achieve cooling is not the cold liquid which is supplied to the evaporator but the warmer liquid which is supplied to the condenser but which in typical operational situations is still cool enough for cooling the motor of the heat pump.

The evaporator base is characterized in that it exhibits a combination functionality. On the one hand, it is ensures that no condenser feed inlets need to be passed through the evaporator, which is under very low pressure. On the other hand, it represents an interface toward the outside, which may have a circular shape since in the case of a circular shape, a maximum amount of evaporator surface area remains. All of the feed inlets/discharge outlets lead through the one evaporator base and from there extend either into the evaporator space or into the condenser space. It is particularly advantageous to manufacture the evaporator base from plastics injection molding since the advantageous, relatively complicated shapes of the intake/drain pipes can be readily implemented in plastics injection molding at low cost. On the other hand, it is readily possible, due to the implementation of the evaporator base as an easily accessible workpiece, to manufacture the evaporator base with sufficient structural stability so that it can readily withstand in particular the low evaporator pressure.

Embodiments of the present invention will be detailed subsequently referring to the appended drawings, in which.

Figure 4A:
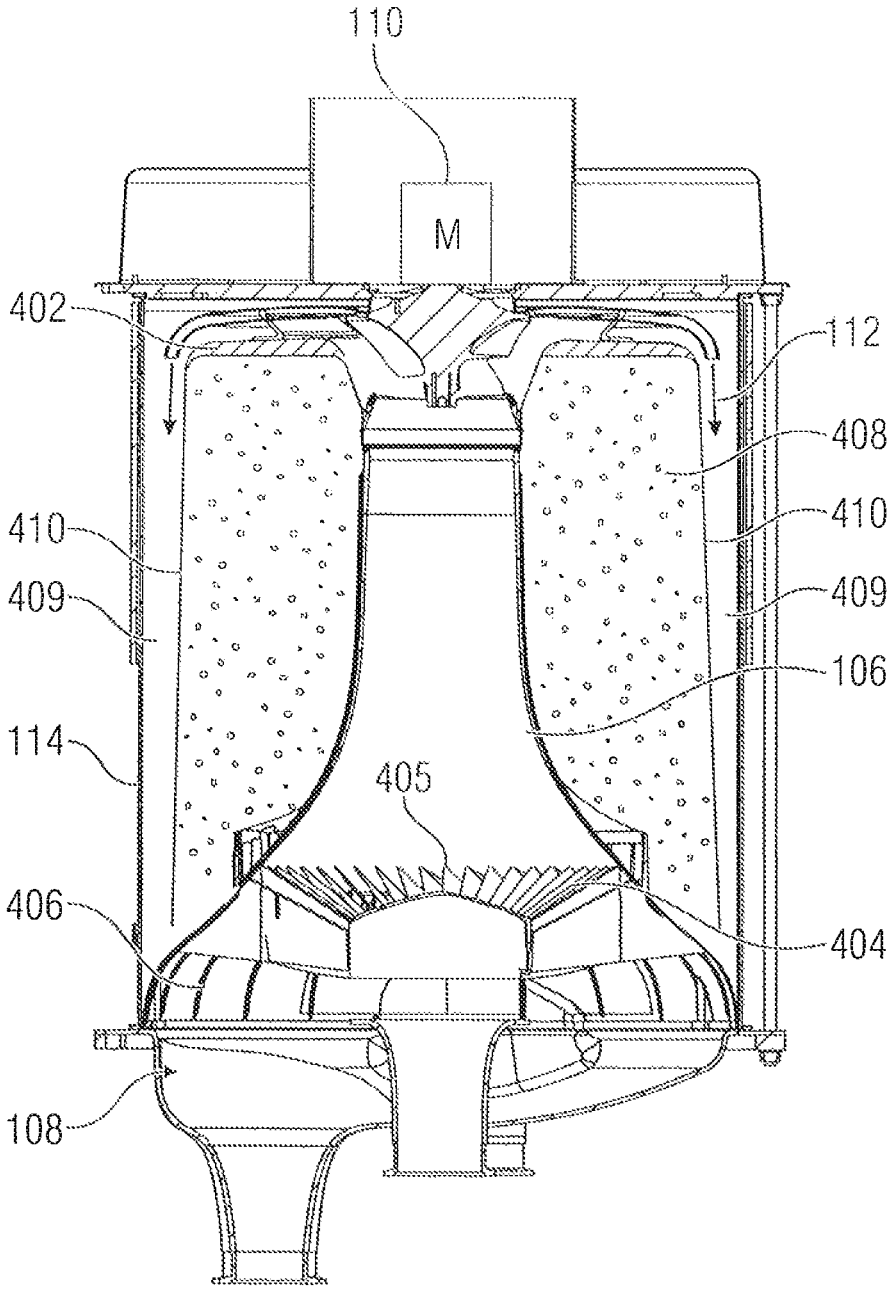
FIG. 4A shows a sectional representation of a heat pump with the evaporator base of FIGS. 3A to 3E and the condenser base of FIGS. 2A and 2B.
Figure 4B:
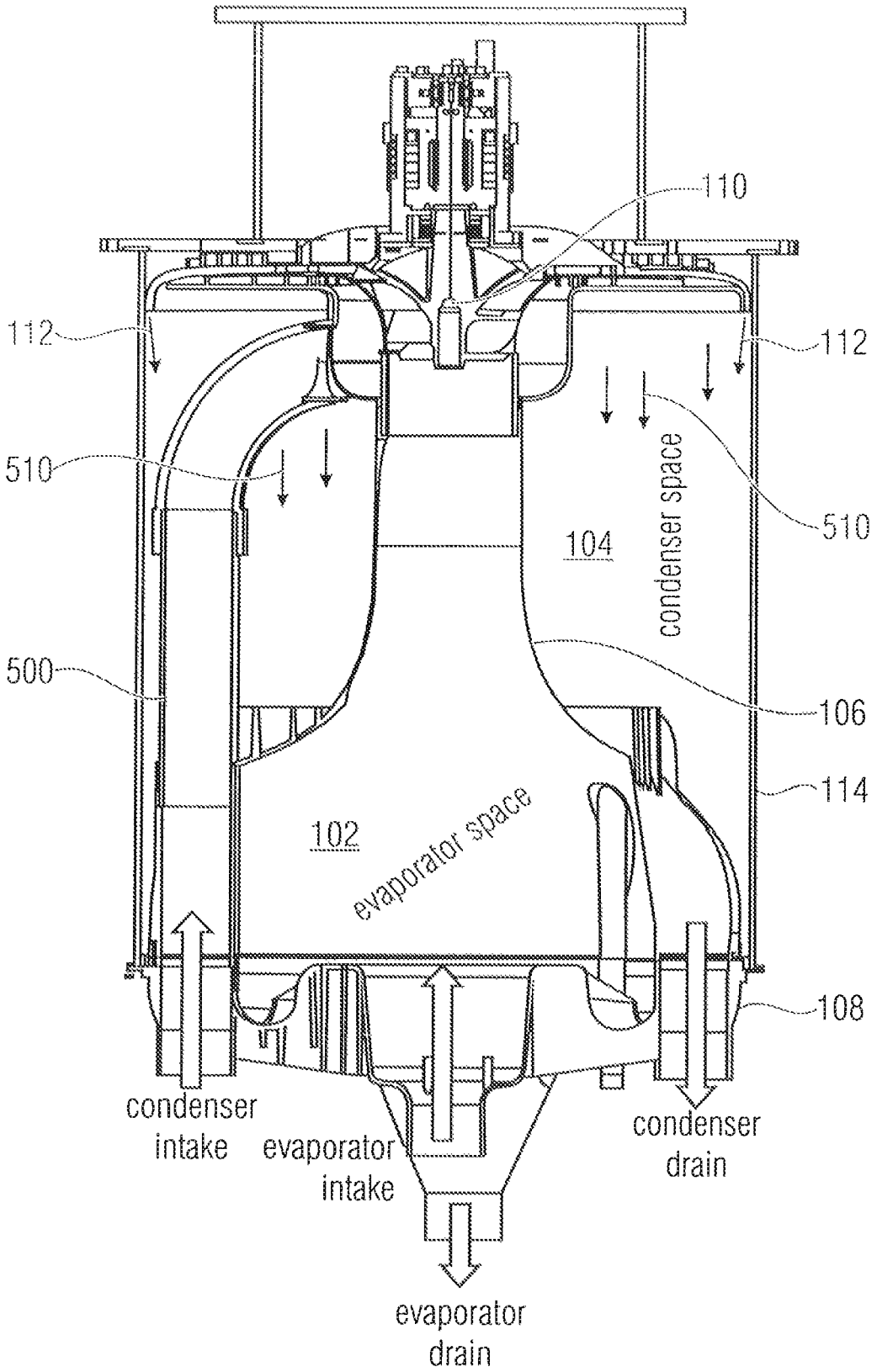
FIG. 4B shows an alternative implementation of the heat pump with a single condenser intake.
Figure 5A:
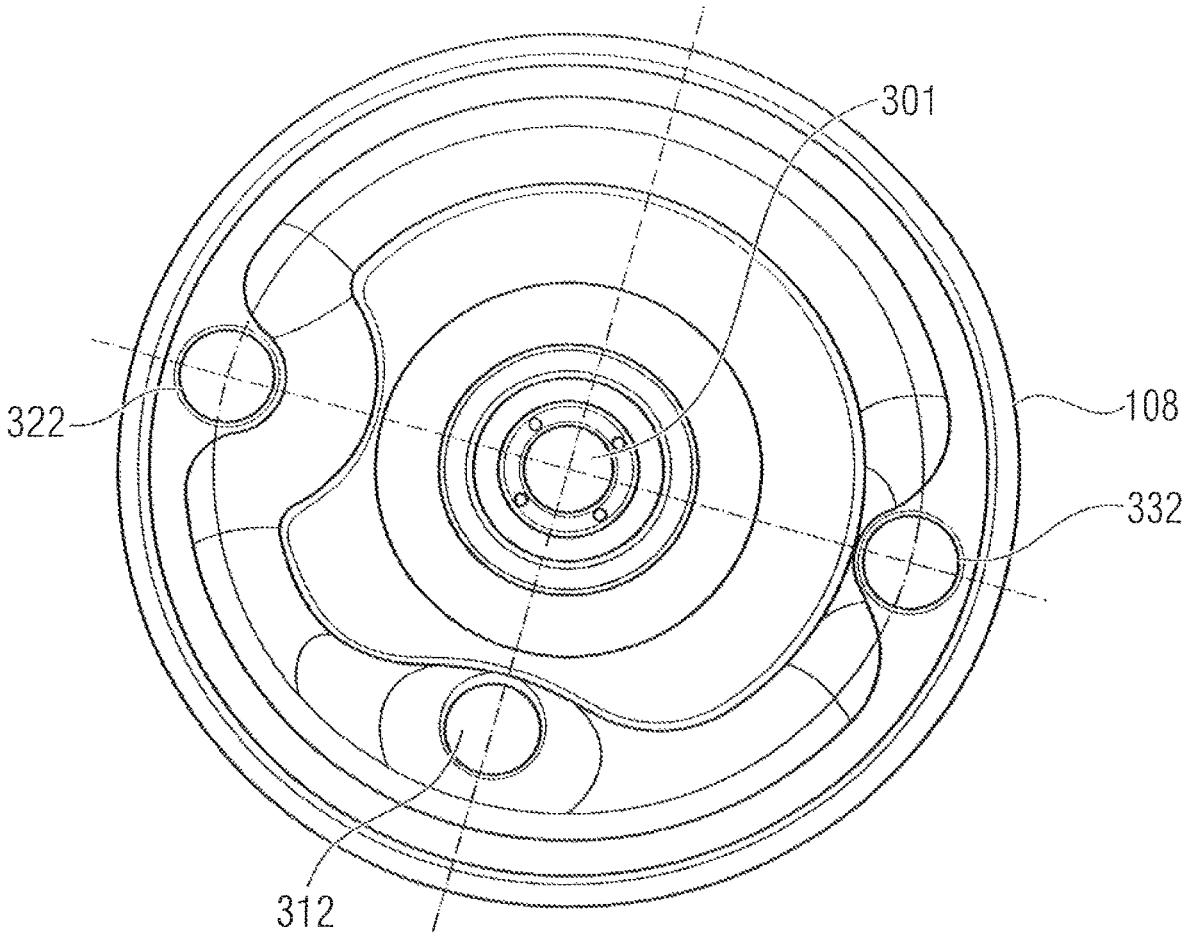
Figure 5B:
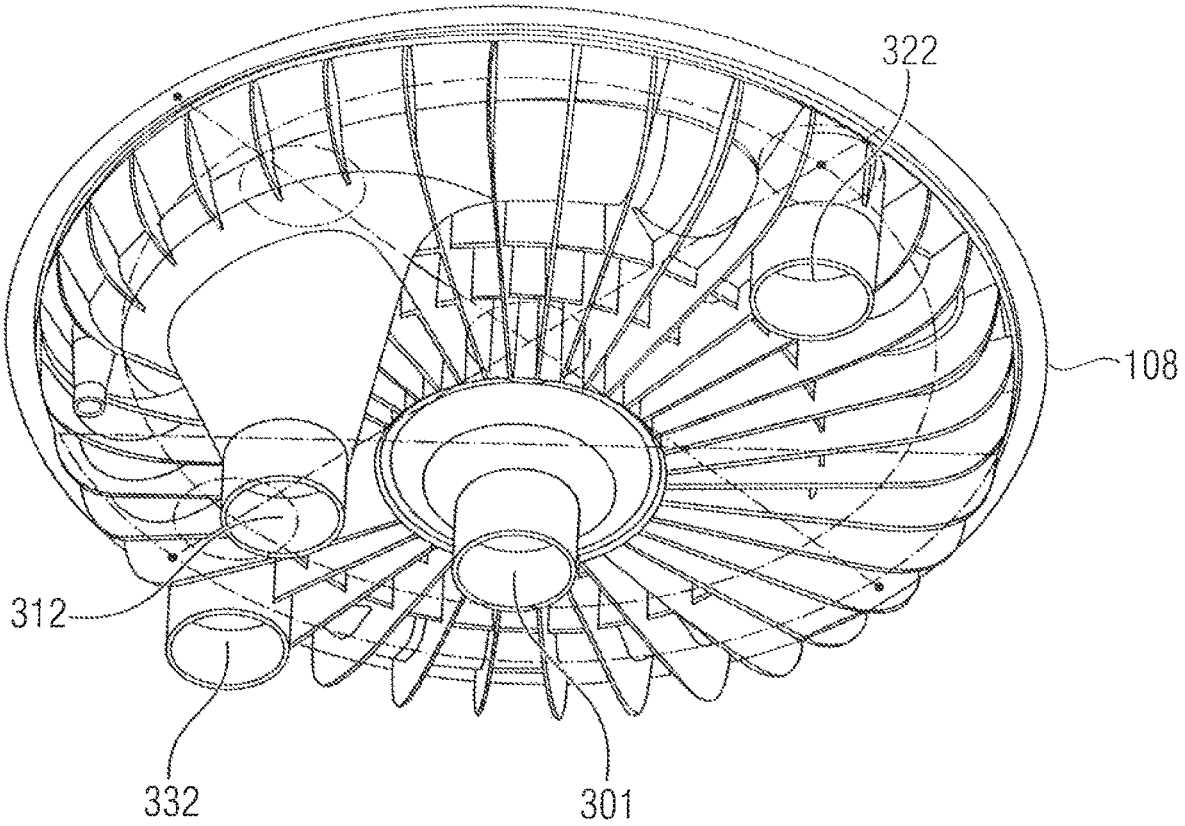
Figure 6:
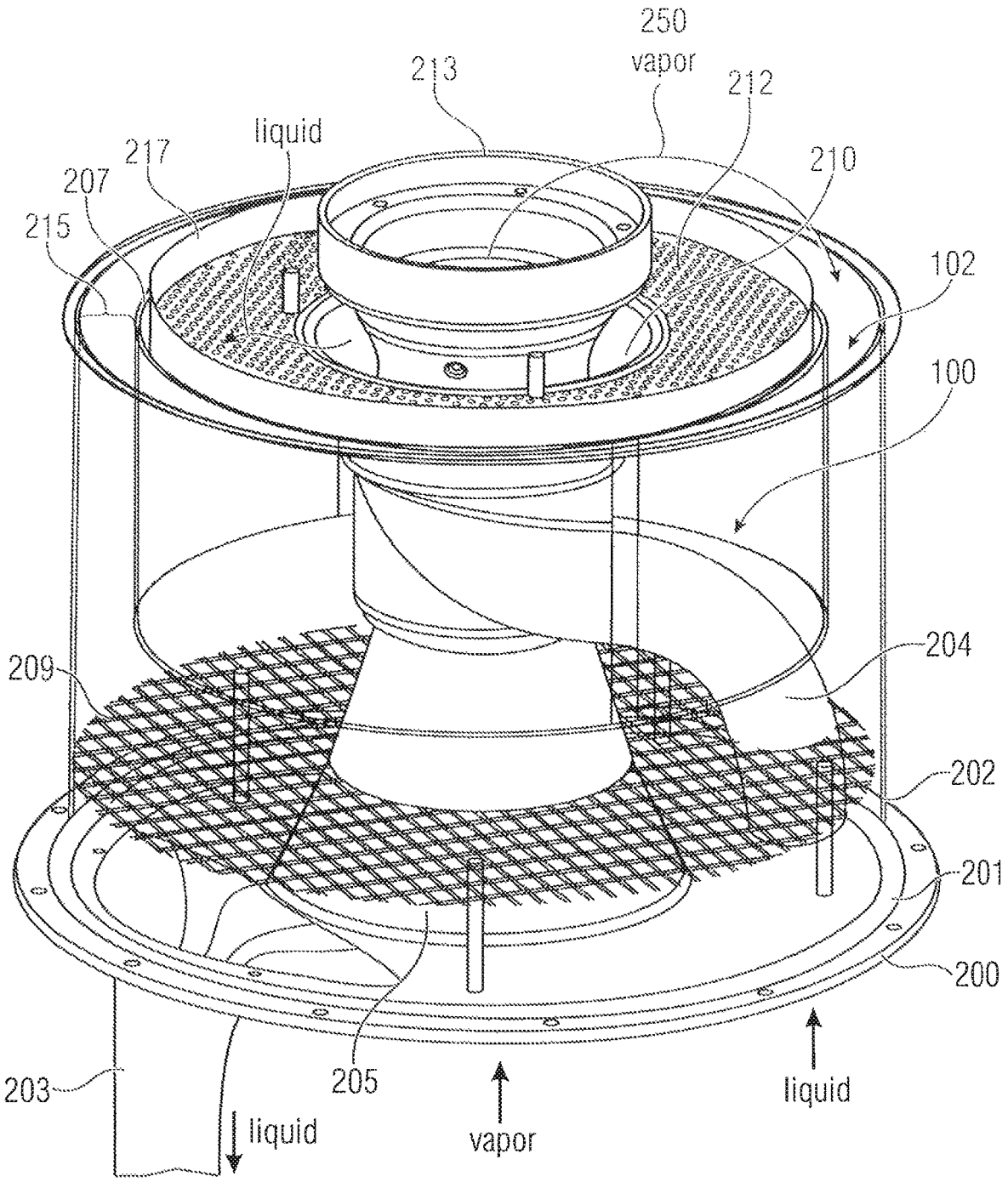
FIG 6 (PRIOR ART)
Figure 7:
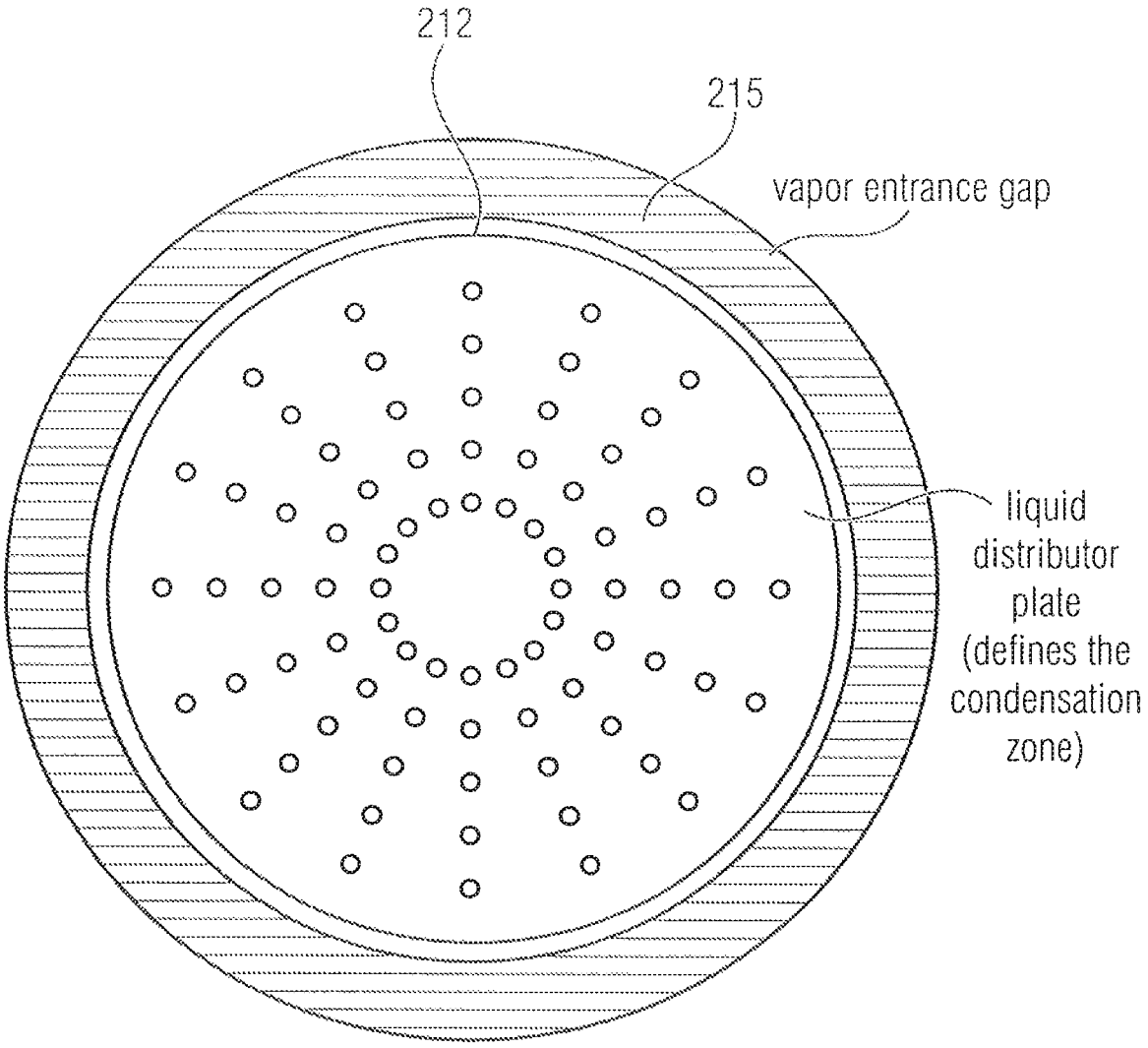
FIG 7 (PRIOR ART)
Figures 8A, 8B:
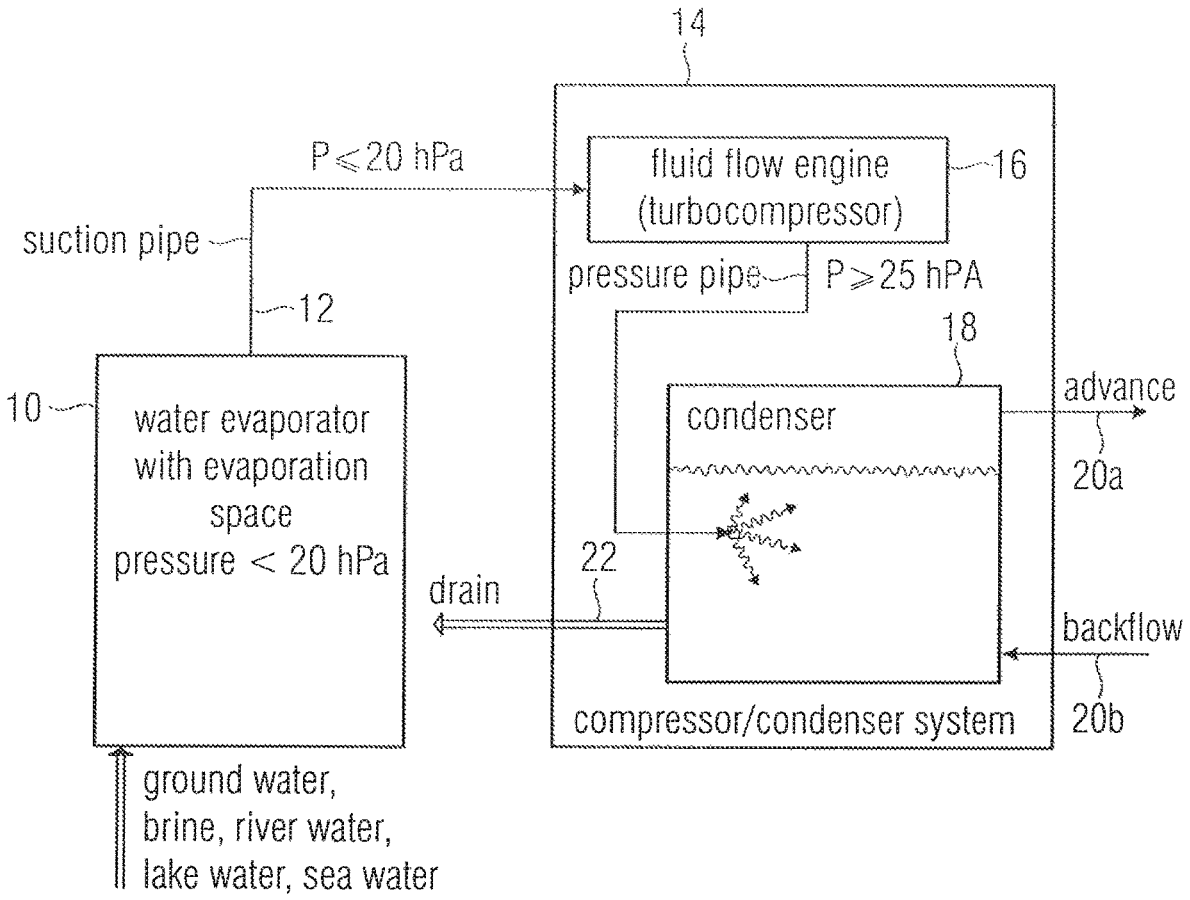
FIG 8A (PRIOR ART)

FIG. 5A a top view of the evaporator base of the embodiment shown in FIG. 4B;

FIG. 5B a perspective bottom view of the evaporator base of FIG. 5A;

FIG. 6 a perspective representation of a condenser as shown in WO 2014072239 A1;

FIG. 7 shows a representation of the liquid distributor plate, on the one hand, and of the vapor entrance zone with a vapor entrance gap, on the other hand, from WO 2014072239 A1;

FIG. 8A shows a schematic representation of a known heat pump for evaporating water; and FIG. 8B shows a table for illustrating pressures and evaporation temperatures of water as a working liquid.

DETAILED DESCRIPTION OF THE INVENTION

Figure 1:
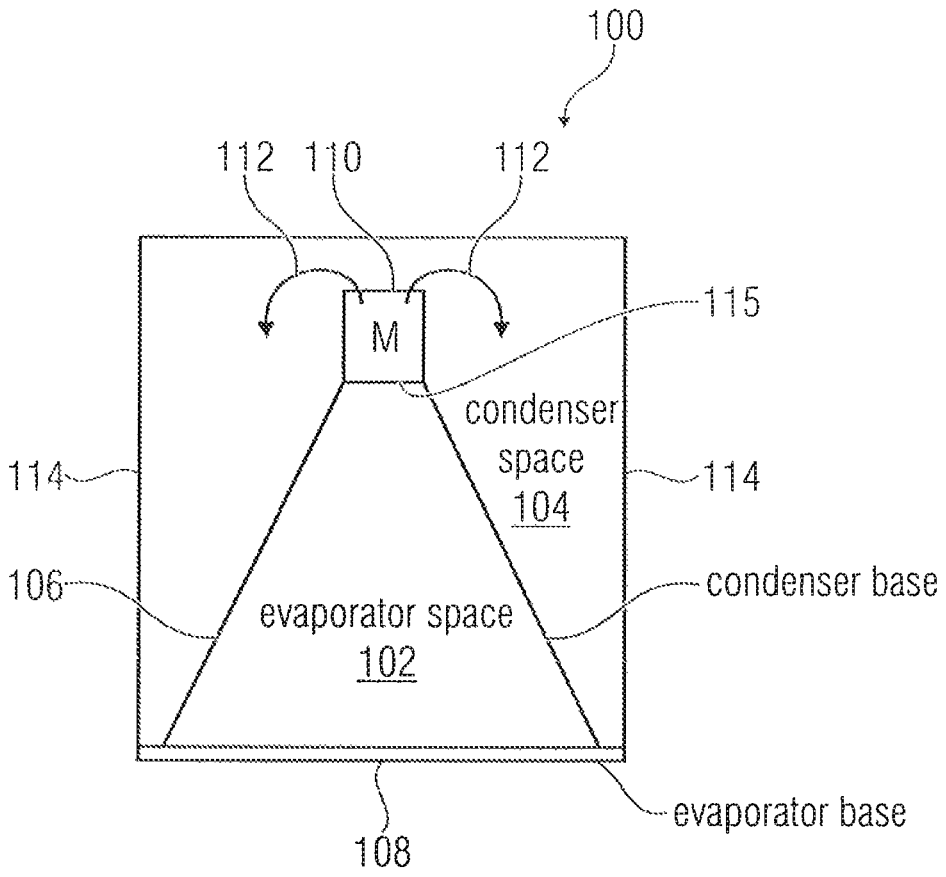
FIG. 1 shows a schematic view of a heat pump in accordance with an embodiment.

FIG. 1 shows a heat pump 100 comprising an evaporator for evaporating working liquid within an evaporator space 102. The heat pump further includes a condenser for condensing evaporated working liquid within a condenser space 104 bounded by a condenser base 106. As shown in FIG. 1, which can be regarded both as a sectional representation and as a side view, the evaporator space 102 is at least partially surrounded by the condenser space 104. Moreover, the evaporator space 102 is separated from the condenser space 104 by the condenser base 106. In addition, the condenser base is connected to an evaporator base 108 so as to define the evaporator space 102. In one implementation, a compressor 110 is provided above the evaporator space 102 or at a different location, said compressor 110 not being explained in detail in FIG. 1 but being configured, in principle, to compress evaporated working liquid and to direct same into the condenser space 104 as compressed vapor 112. Moreover, the condenser space is bounded toward the outside by a condenser wall 114. The condenser wall 114 is also attached to the evaporator base 108, as is the condenser base 106. In particular, the dimensioning of the condenser base 106 in the area forming the interface with the evaporator base 108 is such that in the embodiment shown in FIG. 1, the condenser base is fully surrounded by the condenser space wall 114. This means that the condenser space extends right up to the evaporator base, as shown in FIG. 1, and that the evaporator base simultaneously extends very far upward, typically almost through the entire condenser space 104.

This "interleaved" or intermeshing arrangement of the condenser and the evaporator, which arrangement is characterized in that the condenser base is connected to the evaporator base, provides a particularly high level of heat pump efficiency and therefore enables a particularly compact design of a heat pump. In terms of order of magnitude, dimensioning of the heat pump, e.g., in a cylindrical shape, is such that the condenser wall 114 represents a cylinder having a diameter of between 30 and 90 cm and a height of between 40 and 100 cm. However, the dimensioning can be selected as a function of the power class of the heat pump that may be used, but will range within the dimensions mentioned. Thus, a very compact design is achieved which additionally is easy to produce at low cost since the number of interfaces, in particular for the evaporator space subjected to almost a vacuum, can be readily reduced when the evaporator base in accordance with embodiments of the present invention is configured such that it includes all of the liquid feed inlets/discharge outlets and such that, as a result, no liquid feed inlets/discharge outlets from the side or from the top may be used.

In addition, it shall be noted that the operating direction of the heat pump is as shown in FIG. 1. This means that during operation, the evaporator base defines the lower portion of the heat pump, however, apart from lines connecting it to other heat pumps or to corresponding pump units. This means that during operation, the vapor produced within the evaporator space rises upward and is redirected by the motor and is fed into the condenser space from top to bottom, and that the condenser liquid is directed from bottom to top and is then supplied to the condenser space from the top and then flows from top to bottom within the condenser space such as by means of individual droplets or by means of small liquid streams so as to react with the compressed vapor, which is supplied in a transverse direction, for the purposes of condensation.

Figure 2A:
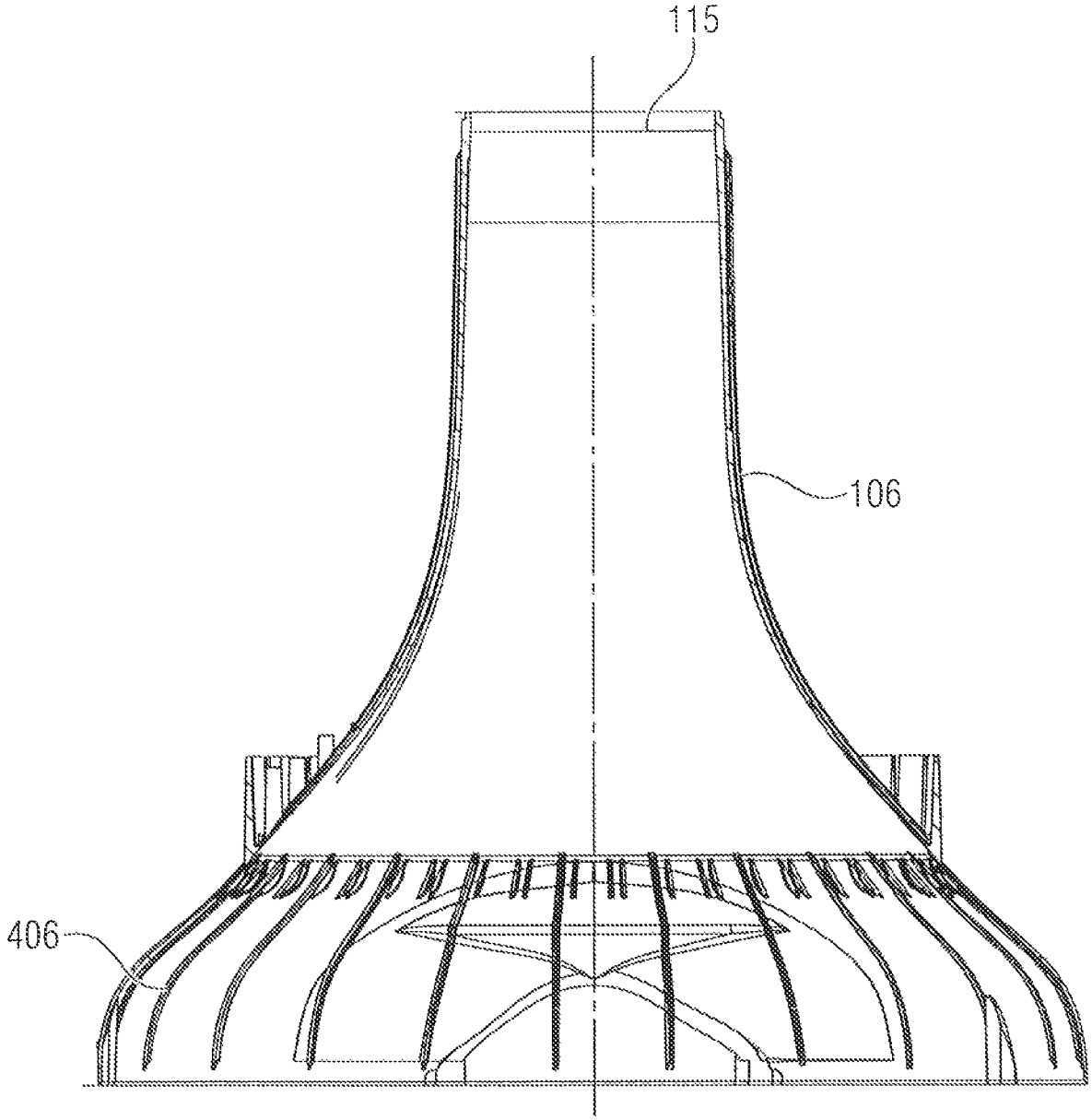
FIG. 2A shows a side view of the condenser base.
Figure 2B:
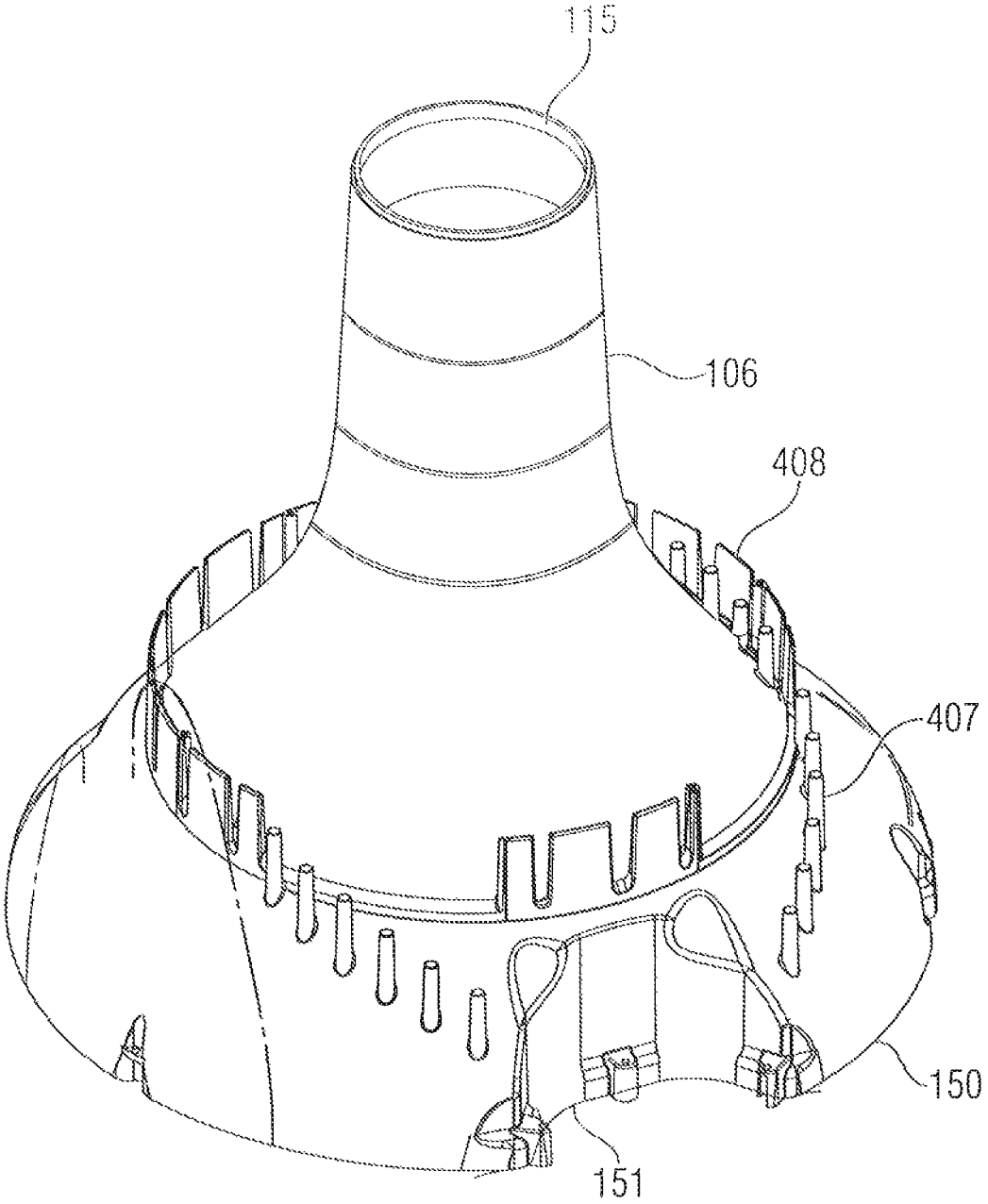
FIG. 2B shows a perspective view of the condenser base.

FIG. 2A and FIG. 2B show a condenser base 106 in accordance with an embodiment of the present invention. In addition, FIGS. 3A to 3E show an evaporator base 108 in accordance with an embodiment of the present invention, FIG. 4A showing a complete heat pump in a sectional representation, said heat pump including both the evaporator base 108 and the condenser base 106.

As shown in FIGS. 3A to 4A or also in FIG. 1, the condenser base 106 has a cross-section tapering from an intake for the working liquid to be evaporated to an exhaust opening 115 coupled to the compressor, or motor, 110, i.e., where the used radial impeller of the motor exhausts the vapor generated within the evaporator space 102.

Figure 3A:
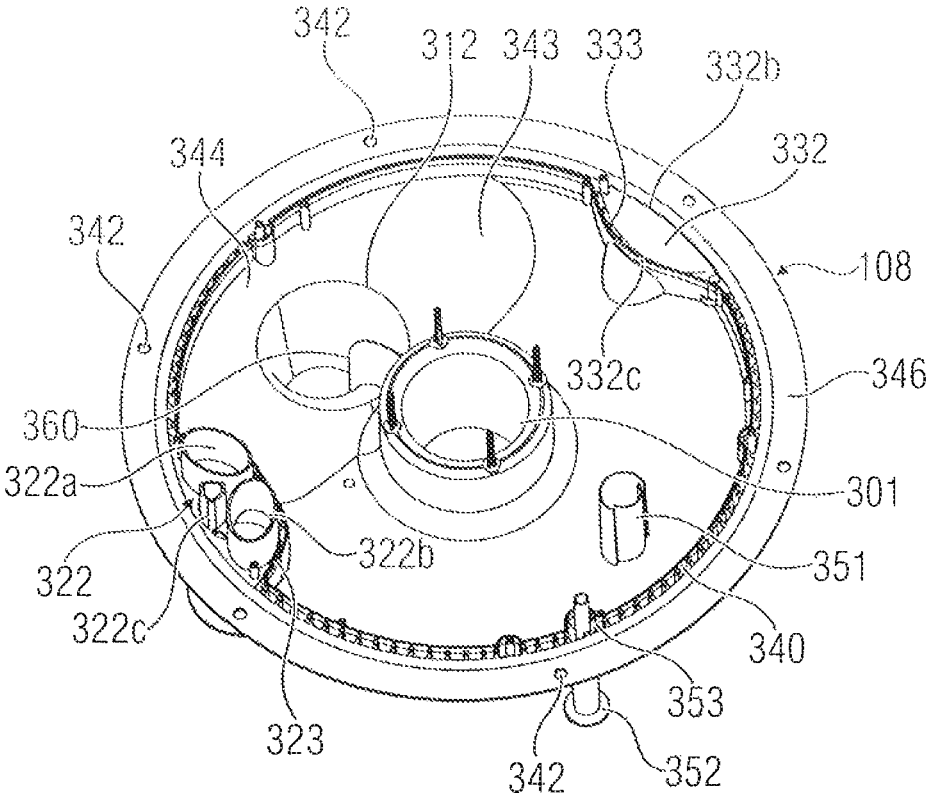
FIG. 3A shows a top view of the evaporator base.

As shown in FIGS. 3A to 3E, the evaporator base includes an evaporator intake 301 for the working liquid to be evaporated and an evaporator drain 312 for a working liquid cooled by the evaporation. In the embodiments shown in FIGS. 3A to 3E, the evaporator base further includes a condenser intake 322 for condenser liquid and a condenser drain 332 for a condenser liquid heated because of the condensation. The condenser intake 322 or the condenser drain 332 are arranged on the evaporator base 108 such that a connection from the condenser intake 322 and/or condenser drain 332 to the respective locations within the condenser space extends outside the evaporation space 102. In embodiments this means, as shown in FIG. 3A, that the condenser intake 322 and the condenser drain 332 are arranged externally on the evaporator base, specifically outside an interface shown at 340 in FIG. 3A, where the condenser base of FIG. 2A or FIG. 2B is "placed" for creating a pressure-tight connection. To this end, the condenser intake 322 is located within a recess 323, and the condenser drain 332 is also located within a recess 333 of the interface 340, the recesses 323, 333 relating to the circular shape of the evaporator-base bed plate.

Said evaporator-base bed plate includes bores 342 on which the typically cylindrical condenser wall can be mounted, as will be described below with reference to FIG. 4A.

The evaporator base further includes a first connection interface 346 for attaching a condenser wall as well as a second connection interface 342 for attaching a condenser base.

In embodiments, in the evaporator base, the first connection interface 346 for attaching the condenser wall is configured such that is surrounds the second connection interface 342 for attaching the condenser base. Moreover, the first connection interface 346 for attaching the condenser wall is configured to be flat in further embodiments, and the second connection interface 342 for attaching the condenser base is configured to protrude in relation to the first connection interface. This can be seen in FIG. 3A, for example, the bores 342 being configured in the flat first connection interface.

The condenser intake and the condenser drain are arranged on the edge of the evaporator base, while for optimum evaporation, the evaporator intake and/or the evaporator drain are arranged within a central region of the evaporator base. In particular, the evaporator intake 301 is located centrally, i.e., in the center of the circular evaporator base, as can be seen particularly in FIG. 3E. In addition, the evaporator drain is located relatively close to the evaporator intake at 312 in FIG. 3E, for example. The evaporator drain 312 is arranged as far away as possible from the evaporator intake. However, it is advantageous for a certain distance to be taken, specifically in order to facilitate reliable and durable sealing, on the one hand, and to achieve a good flow behavior of the cooled evaporator liquid on the evaporator base, on the other hand.

Moreover, the region around the evaporator drain 312 is configured such that the "level" is lower than in the opposite region, so that the working liquid present on the evaporator base drains off toward the evaporator drain 312 from any position of the evaporator base and enters the drain pipe, if possible, without any cavitations and/or inevitable formation of eddies. This means that, for example within a region 343, the slope of the evaporator base toward the evaporator drain is less pronounced than within a region 344 since within the region 344 there is the problem that the drain 312 should be arranged as close as possible to the edge of the evaporator base in order to achieve good flow accumulation.

In addition, the evaporator base further includes a first sensor connection 351 and a second sensor connection 352. The first sensor connection 351 serves to detect a filling level within the evaporator space. The second sensor connection 352 serves to detect a temperature within the condenser space. Similar to the connections 322, 332, it thus also comprises a recess 353 in the connection interface for the condenser base defining the evaporator space which during operation is almost under a vacuum. The connection interface 346, in contrast, is configured to be without any recesses and to be circular so that the condenser wall can be screwed on there, as the case may be, while using gaskets. However, the pressure within the condenser is not as low as that within the evaporator space, so that the requirements placed upon the connection via the interface 346 are substantially lower than those for the interface 340.

The condenser intake 322 is configured to consist of several parts. It includes a first component 322*a* and a second component 322*b* as well as, depending on the implementation, a smaller third component 322*c*. The first connection 322*a* and the second connection 322*b* as well as the third connection 322*c* extend into a shared connection 322*d* on the other side of the evaporator base. The first side, i.e., the lower side of the evaporator base, thus comprises the circular connection 322*d*, which along the connection pipe 322*e* splits up into the three portions 322*a*, 322*b*, 322*c*, at a corresponding connection pipe 322*e* extending away from the evaporator base. Moreover, the condenser may have a condenser liquid distribution arrangement, as is schematically shown at 402 in FIG. 4A, which comprises two or more feeding points. A first feeding point is therefore connected to the first portion 322*a* of the condenser intake. A second feeding point is connected to a second portion 322*b* of the condenser intake. Should there be more feeding points for the condenser liquid distribution means, the condenser intake will be split up into further portions. The third condenser intake portion 322 is connectable to a hose leading to a motor cooling means so that condenser liquid can flow around the motor 110 so as to achieve "liquid" cooling, as it were, which in particular is water cooling when the liquid used is water, which is advantageous.

Figure 3B:
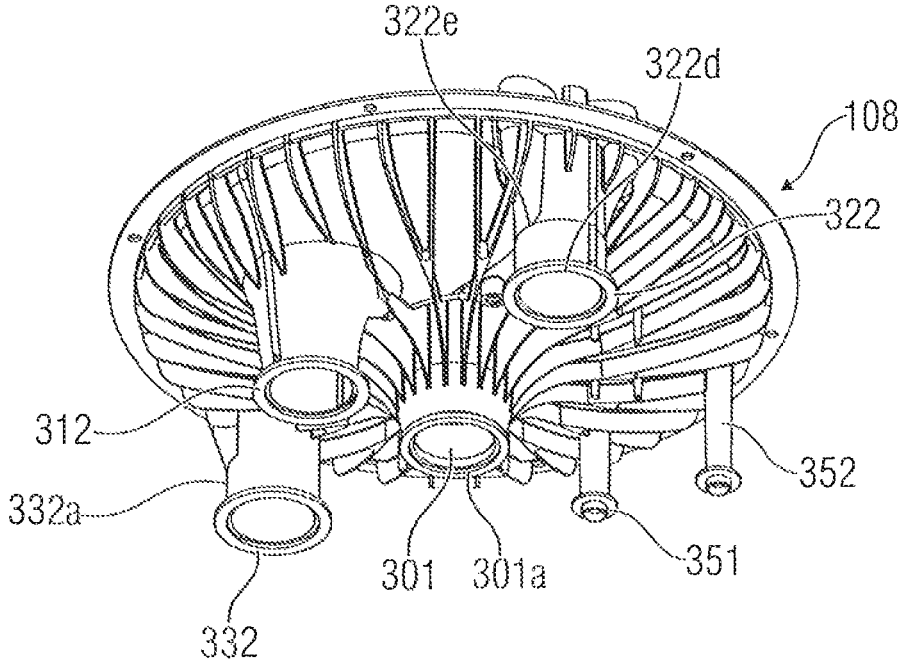
FIG. 3B shows a bottom view of the evaporator base.
Figure 3C:
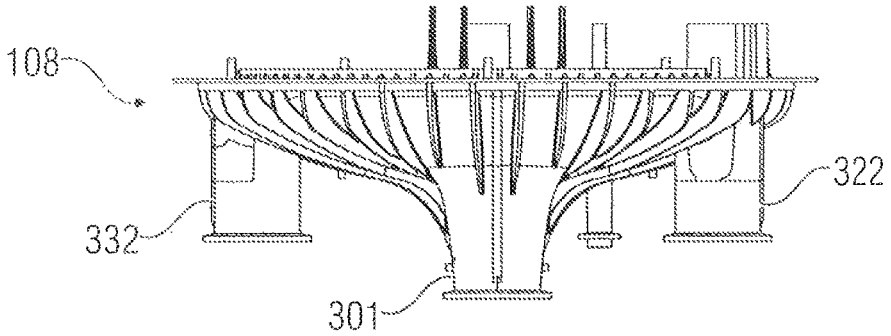
FIG. 3C shows a side view of the evaporator base.
Figure 3D:
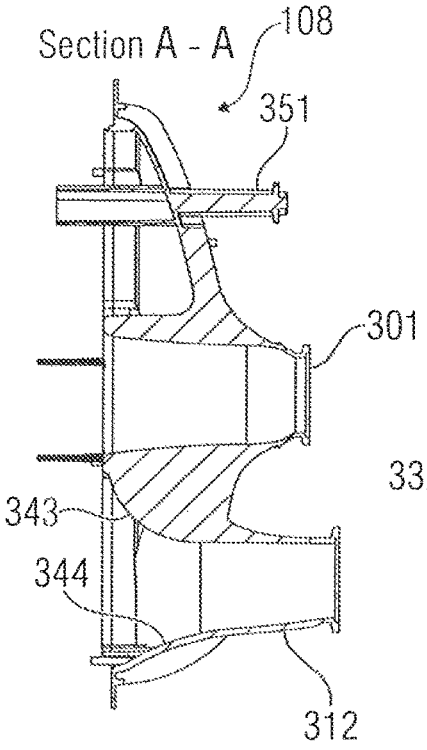
FIG. 3D shows a section through the evaporator base.
Figure 3E:
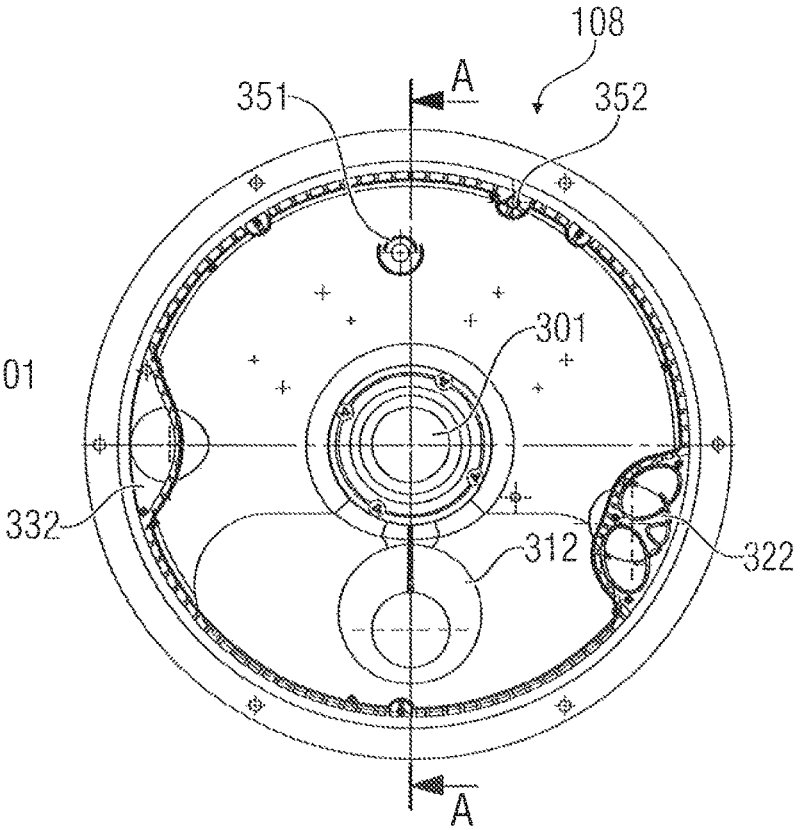
FIG. 3E shows a top view of the evaporator base.

As shown in FIG. 3B, the condenser intake includes the shared connection pipe 322*e*, which has a circular shape, whereas the individual portions 322*a*, 322*b*, i.e., the split-up condenser intake portions, have elliptical cross-sections, the principal axes of the two elliptical cross-sections being arranged in a mutually oblique manner, as shown in FIG. 3A, for example.

In one embodiment, the condenser drain includes, on the upper side of the evaporator base, shown in FIG. 3A, an "upholstery nozzle" shape, as it were, while it again has a circular shape on the second side, or lower side, of the evaporator base 108, said circular shape being bounded by a nozzle 332*a* in the downward direction. The shape of the condenser drain 332 on the upper side is such that a first boundary is that segment of the circle which at the same time is the boundary of the circular evaporator base, as shown at 332*b*. In contrast, the second portion 332*c* has a rather crescent-type shape that has a more pronounced curvature than the first portion 322*b*, to the effect that the evaporator space will be impaired to as small an extent as possible by the recess 333.

In general, the condenser drain has a rather eye-type shape on the upper side and has a round shape on the lower side at the end of the nozzle 332*a*. In particular, the connection pipe is configured, along its extension, such that a cross-sectional area along the connection pipe from the upper side to the lower side and to the end of the nozzle is identical within a tolerance of ±10% and that an inner wall of the connection pipe extends without any steps and discontinuities.

In the implementation shown in FIGS. 3A to 3E, the evaporator base includes a reinforcement rib 360 arranged between the evaporator intake 301 and the evaporator drain 312. The reinforcement rib 360 is arranged, in particular, on an outer surface of the evaporator intake, which outer surface extends for a certain stretch within the evaporator base, and on an inner surface of the evaporator drain pipe. The reinforcement rib 360 provides structural stability, on the one hand, and interrupts a flow around the evaporator intake, on the other hand. In particular, the reinforcement rib 360 is configured such that it "intercepts", as it were, the liquid impinging upon the reinforcement rib and redirects same into the evaporator drain so that a good and efficient drain flow is achieved.

FIG. 2A and FIG. 2B show a side view and a perspective view, respectively, of a condenser base as can be placed onto the evaporator base of FIGS. 3A to 3E. In particular, the condenser base includes, on its lower side, an essentially circular interface 150, which has recesses 151 arranged therein, however, specifically for the condenser intake and the condenser drain as well as for the second sensor connection 352 of FIG. 3A. In FIG. 2B, the perspective view shows merely the recess 151 for the condenser intake, whereas the recess, not shown in FIG. 2B, for the condenser drain is located opposite.

The condenser base has an almost "chimney-type" shape and extends from bottom to top, the cross-section continually decreasing from the bottom toward the top, so that the condenser base blends into a pipe having a relatively small cross-section as compared to the overall cross-section of the evaporator base, which pipe is shown at 115 in FIGS. 2A and 2B and represents the "suction mouth" for the evaporated working liquid. In particular, the condenser base has a shape that is round, apart from the recesses 151, in an attachment region 150 for attachment to the evaporator base. Moreover, the condenser wall 114 has a round shape in the attachment region on the evaporator base as well, the diameter of which shape, however, being larger than that of the condenser base, so that the condenser space extends right up to the evaporator base and the condenser base is arranged within the condenser wall.

FIG. 4A shows a cross-section through the entire heat pump. What is shown, in particular, is that a droplet separator 404 is arranged within the condenser base. Said droplet separator includes individual blades 405. So that the droplet separator remains in its position, said blades are inserted into corresponding grooves 406 which are shown in FIG. 4A and are also shown in FIG. 2A. Said grooves are arranged, within the condenser base, in a region pointing toward the evaporator base, in the inside of the evaporator base. In addition, as shown in FIG. 2B, the condenser base further has various guiding features which can be configured as small rods 407 or tongues 408 for holding hoses provided, e.g., for a condenser water guidance, i.e., which are placed onto the portions 322*a*, 322*b* and possibly 322*c* and which couple the feeding points of the condenser water feed inlet. Said condenser water feed inlet 402 may be configured, depending on the implementation, such as is shown at reference numerals 102, 207 to 250 in FIGS. 6 and 7.

FIG. 6 shows an embodiment of a condenser, the condenser in FIG. 6 comprising a vapor introduction zone 102 extending completely around the condensation zone 100. In particular, FIG. 6 shows a part of a condenser which comprises a condenser base 200. The condenser base has a condenser housing portion 202 arranged thereon which is drawn to be transparent in the representation of FIG. 6 but in reality need not necessarily be transparent but may be formed from plastic, die-cast aluminum or the like. The lateral housing part 202 rests upon a rubber seal 201 so as to achieve good sealing with the base 200. Moreover, the condenser includes a liquid drain 203 and a liquid intake 204 as well as a vapor feed inlet 205 centrally arranged within the condenser and tapering from bottom to top in FIG. 6. It shall be noted that FIG. 6 represents the actually desired installation direction of a heat pump and of a condenser of said heat pump; in this installation direction in FIG. 6, the evaporator of a heat pump is arranged below the condenser.

The condensation zone 100 is bounded toward the outside by a basket-like boundary object 207, which just like the outer housing part 202 is drawn to be transparent and is normally configured in a basket-like manner.

Moreover, a grid 209 is arranged which is configured to support fillers not shown in FIG. 6. As can be seen from FIG. 6, the basket 207 extends downward to a certain point only. The basket 207 is provided to be permeable to vapor so as to obtain fillers such as so called Pall rings, for example. Said fillers are introduced into the condensation zone, but only within the basket 207 and not within the vapor introduction zone 102. The fillers, however, are filled in to such a level, even outside the basket 207, that the height of the fillers extends either to the lower boundary of the basket 207 or slightly beyond.

The condenser of FIG. 6 includes a working liquid feeder which is formed—in particular by the working liquid feed inlet 204 which, as shown in FIG. 6, is arranged to be wound around the vapor feed inlet in the form of an ascending turn—by a liquid transport region 210 and by a liquid distributor element 212 which may be configured as a perforated plate. In particular, the working liquid feeder is thus configured to feed the working liquid into the condensation zone.

In addition, a vapor feeder is also provided which, as shown in FIG. 6, may be composed of the feeding region 205, which tapers in a funnel-shaped manner, and the upper vapor guiding region 213. Within the vapor guiding region 213, a wheel of a radial compressor may be employed, and the radial compression results in that vapor is sucked from the bottom upward through the feed inlet 205 and is then redirected, on account of the radial compression, by the radial wheel by 90 degrees to the outside, as it were, i.e. from flowing bottom-up to flowing from the center to the outside in FIG. 6 with regard to the element 213.

What is not shown in FIG. 6 is a further redirecting unit, which redirects the vapor that has already been redirected toward the outside by another 90 degrees so as to then direct it from above into the gap 215 which represents the beginning of the vapor introduction zone, as it were, which extends laterally around the condensation zone. The vapor feeder is therefore configured to be ring-shaped and provided with a ring-shaped gap for feeding the vapor to the condensed, the working liquid feed inlet being configured within the ring-shaped gap.

Please refer to FIG. 7 for illustration purposes. FIG. 7 shows a view of the "lid region" of the condenser of FIG. 6 from below. In particular, the perforated plate 212 which acts as a liquid distributor element is schematically depicted from below. The vapor entrance gap 215 is drawn schematically, and FIG. 7 shows that the vapor introduction gap is configured to be merely ring-shaped, such that vapor to be condensed is fed into the condensation zone neither directly from above nor directly from below, but is fed in from the sides all around only. Thus, only liquid, but no vapor, will flow through the holes of the distributor plate 212. The vapor is "sucked into" the condensation zone only from the sides, namely because of the liquid that has passed through the perforated plate 212. The liquid distributor plate may be formed from metal, plastic or a similar material and can be implemented with different hole patterns. As shown in FIG. 6, what is also to be provided is a lateral boundary for liquid flowing out of the element 210, said lateral boundary being designated by 217. In this manner it is ensured that liquid which exits the element 210 already with an angular momentum due to the curved feed inlet 204 and is distributed on the liquid distributor from the inside toward the outside will not splash over the edge into the vapor introduction zone, provided that the liquid has not previously dropped through the holes of the liquid distributor plate and has condensed with vapor.

The upper region of the heat pump of FIG. 4A may thus be configured just like the upper region in FIG. 6, to the effect that feeding of the condenser water takes place via the perforated plate of FIG. 6 and FIG. 7, so that condenser water 408 trickling down is obtained into which the working vapor 112 is introduced in a lateral manner, so that cross-flow condensation, which allows a particularly high level of efficiency, can be obtained. As also depicted in FIG. 6, the condensation zone may be provided with a filling wherein the edge 207, which is also designated by 409, remains free from fillers or the like, to the effect that the working vapor 112 can still laterally enter into the condensation zone not only at the top, but also at the bottom. The imaginary boundary line 410 is to illustrate this in FIG. 4A.

In the embodiment shown in FIG. 4A, however, the entire area of the condenser is configured with a condenser base 200 of its own which is configured above an evaporator base not shown in FIG. 6.

FIG. 4B shows an alternative heat pump having an evaporator space and a condenser space, which again are arranged in a mutually interleaved manner. Moreover, the heat pump includes the evaporator base 108 and the condenser base 106 which, however, may be configured to be different from the elements shown in FIGS. 2 to 4. Moreover, a condenser connecting line 500 is shown, which may correspond to the feeding line 204 of FIG. 6 when one considers that only the upper side of the condenser space is configured as shown in FIG. 6. In addition, the evaporated working liquid is again fed in laterally via a gap, as shown at 112, whereas the condenser liquid trickles down, within the entire condenser space, from top to bottom, in the shape of drops or droplets, as shown at 510.

The condenser base of FIG. 4B is depicted in more detail in FIG. 5A and FIG. 5B and again includes a condenser intake 322, a condenser drain 332, an evaporator intake 301 and an evaporator drain 312. Moreover, the evaporator base is configured with reinforcement ribs as shown in FIG. 5B, so that it can be manufactured by means of plastics injection molding while exhibiting good structural stability.

Even though the evaporator base is described, e.g. in accordance with the implementation of FIGS. 3A to 3E, in connection with the condenser base, it shall be noted that the condenser base and the evaporator base can be produced and employed separately since they are connected by screwed connections anyhow. Thus, the evaporator base may be connected to a condenser base deviating from FIGS. 2A and 2B. Likewise, the condenser base of FIGS. 2A and 2B may be connected to a different one than the evaporator base of FIGS. 3A to 3E.

In addition, the heat pump as is schematically shown in FIG. 1 may be implemented with elements deviating from the embodiments described, provided that the interleaved condenser/evaporator combination is maintained wherein the condenser base is connected to the evaporator base, even though the specific design of the corresponding elements may vary. All of the descriptions contained within this application which relate to the evaporator base equally relate to the entire heat pump, and vice versa. This means that all of the descriptions of the heat pump which show the features of the evaporator base also relate to the evaporator base by itself, even though this was not explicitly stated every time.

Finally it shall be noted that the heat pump and the evaporator base may be used in combination or separately from each other.

Examples of the present invention are set forth as follows:

1. Evaporator base comprising:
   an evaporator intake (301) for the working liquid to be evaporated;
   an evaporator drain (312) for a working liquid cooled by the evaporation;
   a condenser intake (322) for a condenser liquid; and
   a condenser drain (332) for a condenser liquid heated up due to the condensation, or
   wherein the evaporator intake (301), the evaporator drain (312), the condenser intake (322) and the condenser drain (332) are configured as passage openings within an evaporator-base bed plate.
2. Evaporator base of example 1, wherein the condenser intake (322) is arranged on the evaporator base (108) such that a connecting hose extending between the condenser intake and a liquid feed inlet into the condenser is arranged completely outside the evaporator space (102).
3. Evaporator base of examples 1 or 2,
   wherein the condenser intake (322) or the condenser drain (332) are arranged on an edge of the evaporator base (108) or wherein the evaporator intake (301) or the evaporator drain (312) are arranged in a central region of the evaporator base (108).
4. Evaporator base of any of examples 1 to 3,
   which comprises a shared portion (322*d*) on a first side and a split portion (322*a*, 322*b*) on a second side.
5. Evaporator base of example 4, wherein the split portion further comprises a further portion (322*c*) on the second side.
6. Evaporator base of any of examples 4 or 5, wherein the shared portion comprises a connection pipe (322*e*) which has a connection that is round, the split portions being elliptical, principal axes of the split portions (322*a*, 322*b*) being arranged in a mutually oblique manner.
7. Evaporator base of any of examples 1 to 6,
   wherein the condenser drain (332) comprises, on a first side of the evaporator base (108), a connection pipe (332*a*) having a round connection and comprises, on a second side, an eye-type shape, the connection pipe (332*a*) being configured such that its cross-sectional area along the connection pipe to the round connection is the same within a tolerance of plus or minus 10% and that an inner wall of the connection pipe (332*a*) extends without any discontinuities,
8. Evaporator base of example 7, wherein the eye-type shape comprises a first portion (332*b*) representing a segment of a circle that is defined by a condenser wall (114), and wherein the eye-type shape comprises a second portion (332*c*) which has a crescent-type shape whose curvature is more pronounced than that of the first portion (332*b*).
9. Evaporator base of any of examples 1 to 8,
   which comprises a reinforcement rib (360) on one side, the reinforcement rib (360) connecting an outer side of the evaporator intake to an inner side of the connection pipe of the evaporator drain.
10. Evaporator base of any of examples 1 to 9,
    wherein an upper side of the evaporator base is curved such that a region facing the evaporator drain is located lower down than a region arranged at a distance from the evaporator drain, so that a working liquid can flow, in a working position of the evaporator base, from any position of the evaporator base to the evaporator drain due to gravity.
11. Evaporator base of any of examples 1 to 10,
    wherein the evaporator base (108) further comprises a first sensor connection (351) for sensing a temperature within a condenser space (104) and a second sensor connection (352) for sensing a filling level within an evaporator space (102).
12. Evaporator base of any of examples 1 to 11,
    wherein a cross-section of an evaporator intake continually expands from a connecting piece (301*a*) to an upper side of the evaporator base.
13. Evaporator base of any of examples 1 to 12, which comprises a first connection interface (346) for attaching a condenser wall and a second connection interface (342) for attaching a condenser base.
14. Evaporator base of example 13, wherein the first connection interface (346) for attaching the condenser wall is configured such that it surrounds the second connection interface (342) for attaching the condenser base.
15. Evaporator base of examples 13 or 14, wherein the first connection interface (346) for attaching the condenser wall is configured to be flat and the second connection interface (342) for attaching the condenser base is configured to protrude in relation to the first connection interface.
16. Evaporator base of example 1 to 15, wherein the evaporator intake (301), the evaporator drain (312), the condenser intake (322) and the condenser drain (332) are configured as passage openings within an evaporator-base bed plate.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A heat pump comprising:
an evaporator for evaporating working liquid within an evaporator space bounded by an evaporator base;
a condenser for condensing evaporated working liquid within a condenser space bounded by a condenser base; and
a compressor for compressing evaporated working liquid from the evaporator space,
wherein the evaporator space is at least partially surrounded by the condenser space,
wherein the evaporator space is separated from the condenser space by the condenser base,
wherein the condenser base is connected to the evaporator base,
wherein the evaporator base comprises an evaporator intake for the working liquid to be evaporated and an evaporator drain for the working liquid cooled by the evaporation,
wherein the evaporator base further comprises a condenser intake for a condenser liquid, and a condenser drain for a condenser liquid heated up due to the condensation, and
wherein the condenser intake and the condenser drain are arranged on an edge of the evaporator base, and wherein the evaporator intake and the evaporator drain are arranged in a central region of the evaporator base.

2. The heat pump as claimed in claim 1, wherein the condenser base comprises a tapering cross-section from the evaporator intake to an exhaust opening coupled to the compressor for compressing evaporated working liquid from the evaporator space.

3. The heat pump as claimed in claim 1, wherein the condenser intake is arranged on the evaporator base such that a connecting hose extending between the condenser intake and a liquid feed inlet into the condenser is arranged completely outside the evaporator space.

4. The heat pump as claimed in claim 1, wherein the condenser base comprises a first recess for the condenser intake or a second recess for the condenser drain.

5. The heat pump as claimed in claim 1, wherein the condenser further comprises a condenser wall connected to the evaporator base so as to define the condenser space.

6. The heat pump as claimed in claim 1, wherein the condenser base comprises, within an attachment region for attachment to the evaporator base, a round shape whose diameter is larger than a diameter of the condenser base in the attachment region, so that the condenser space extends right up to the evaporator base.

7. The heat pump as claimed in claim 1, comprising a cylindrical outer wall formed by the condenser wall, wherein the condenser space, the evaporator space and the compressor are arranged within the cylindrical outer wall.

8. The heat pump as claimed in claim 1, wherein the condenser comprises a condenser liquid distribution arrangement arranged on an upper side of the condenser space so that during operation of the heat pump, working liquid flows top to bottom in the direction of the condenser base, the compressor being arranged to direct compressed evaporated working liquid into a region through which the working liquid runs during operation, and an upper end of the evaporator space from which the compressor exhausts the evaporated working liquid being arranged within a plane wherein the working liquid within the condenser runs top to bottom.

9. The heat pump as claimed in claim 1, wherein the condenser base comprises a condenser liquid distribution arrangement which comprises two or more feeding points, the evaporator base comprising a split condenser connection comprising a first portion on a first side and one or more second portions on a second side, a number of the one or more second portions being equal to a number of the feeding points.

10. The heat pump as claimed in claim 9, wherein the split portion further comprises a third portion on the second side, said third portion being coupled to a motor for the compressor so as to feed the motor with a portion of the condenser liquid as a cooling liquid for the motor for the compressor.

11. The heat pump as claimed in claim 9, wherein the first portion comprises a connection pipe which comprises a connection that is round, wherein the one or more second portions are elliptical, and wherein principal axes of the split portions are arranged in a mutually oblique manner.

12. The heat pump as claimed in claim 1, wherein the condenser drain comprises, on a first side of the evaporator base, a connection pipe comprising a round connection and comprises, on a second side pointing toward the condenser space, an eye-type shape, the connection pipe being configured such that its cross-sectional area along the connection pipe to the round connection is the same within a tolerance of plus or minus 10% and that an inner wall of the connection pipe extends without any discontinuities.

13. The heat pump as claimed in claim 12, wherein the eye-type shape comprises a first portion representing a segment of a circle that is defined by a condenser wall, and wherein the eye-type shape comprises a second portion which comprises a crescent-type shape whose curvature is more pronounced than that of the first portion.

14. The heat pump as claimed in claim 1, wherein the evaporator base comprises a reinforcement rib on a side pointing toward the evaporator space, the reinforcement rib connecting an outer side of the evaporator intake to an inner side of the connection pipe of the evaporator drain.

15. The heat pump as claimed in claim 1, wherein an upper side of the evaporator base that points toward the evaporator space is curved such that a region facing the evaporator drain is located lower down than a region arranged at a distance from the evaporator drain, so that a working liquid can flow from any position of the evaporator base to the evaporator drain due to gravity.

16. The heat pump as claimed in claim 1, wherein the evaporator base further comprises a first sensor connection for sensing a temperature within the condenser space and a second sensor connection for sensing a filling level within the evaporator space.

17. The heat pump as claimed in claim 1, wherein a cross-section of the evaporator intake continually expands from a connecting piece to an upper side of the evaporator base.

18. The heat pump as claimed in claim 1, wherein the condenser base or the evaporator base are formed from plastic.

19. The heat pump as claimed in claim 1, which further comprises a droplet separator comprising blades, the condenser base comprising, within a region pointing toward the evaporator base, grooves on an inner wall, within which grooves the blades of the droplet separator are attached.

20. The heat pump as claimed in claim 1, wherein the condenser base comprises, on a side pointing toward the condenser space, guiding features for holding hoses for condenser water guidance.

21. The heat pump as claimed in claim 1, wherein the condenser base comprises, apart from recesses, a round shape whose cross-section continually decreases in a direction from the evaporator base toward a suction opening of the evaporator.

22. The heat pump as claimed in claim 1, wherein the evaporator space is bounded, in the operating direction of the heat pump, by the evaporator base in the downward direction, and wherein the condenser base extends right up to the evaporator base.

23. A heat pump comprising:

an evaporator for evaporating working liquid within an evaporator space bounded by an evaporator base;

a condenser for condensing evaporated working liquid within a condenser space bounded by a condenser base; and a compressor for compressing evaporated working liquid from the evaporator space, wherein the evaporator space is at least partially surrounded by the condenser space, wherein the evaporator space is separated from the condenser space by the condenser base, wherein the condenser base is connected to the evaporator base, and wherein the condenser base comprises a condenser liquid distribution arrangement which comprises two or more feeding points, wherein the evaporator base comprises a split condenser connection comprising a first portion on a first side and one or more second portions on a second side, a number of the one or more second portions equaling a number of the feeding points, wherein the first portion comprises a connection pipe which comprises a connection that is round, wherein the one or more second portions are elliptical, and wherein principal axes of the one or more second portions are arranged in a mutually oblique manner, or wherein a condenser drain comprises, on a first side of the evaporator base, a connection pipe comprising a round connection and comprises, on a second side pointing toward the condenser space, an eye-type shape, the connection pipe being configured such that its cross-sectional area along the connection pipe to the round connection is the same within a tolerance of plus or minus 10% and that an inner wall of the connection pipe extends without any discontinuities, or wherein the evaporator base comprises an evaporator intake for the working liquid to be evaporated and an evaporator drain for the working liquid cooled by the evaporation, and wherein the evaporator base comprises a reinforcement rib on a side pointing toward the evaporator space, the reinforcement rib connecting an outer side of the evaporator intake to an inner side of the connection pipe of the evaporator drain, or wherein an upper side of the evaporator base that points toward the evaporator space is curved such that a region facing an evaporator drain is located lower down than a region arranged at a distance from the evaporator drain, so that a working liquid can flow from any position of the evaporator base to the evaporator drain due to gravity, or wherein the evaporator base further comprises a first sensor connection for sensing a temperature within the condenser space and a second sensor connection for sensing a filling level within the evaporator space.

* * * * *